US010980395B2

(12) United States Patent
Kim et al.

(10) Patent No.: US 10,980,395 B2
(45) Date of Patent: Apr. 20, 2021

(54) DISHWASHER

(71) Applicant: SAMSUNG ELECTRONICS CO., LTD., Suwon-si (KR)

(72) Inventors: Do-haeng Kim, Suwon-si (KR); Min-hwan Oh, Suwon-si (KR); Young-hyun Kim, Suwon-si (KR); Young-min Choi, Yongin-si (KR); Won-jae Han, Seoul (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 176 days.

(21) Appl. No.: 16/086,903

(22) PCT Filed: Mar. 23, 2017

(86) PCT No.: PCT/KR2017/003098
§ 371 (c)(1),
(2) Date: Sep. 20, 2018

(87) PCT Pub. No.: WO2017/171300
PCT Pub. Date: Oct. 5, 2017

(65) Prior Publication Data

US 2019/0104916 A1 Apr. 11, 2019

(30) Foreign Application Priority Data

Mar. 28, 2016 (KR) ..... 10-2016-0036657

(51) Int. Cl.
*A47L 15/48* (2006.01)
*A47L 15/00* (2006.01)
*A47L 15/42* (2006.01)

(52) U.S. Cl.
CPC ..... *A47L 15/488* (2013.01); *A47L 15/00* (2013.01); *A47L 15/4257* (2013.01); *A47L 15/48* (2013.01); *A47L 15/486* (2013.01)

(58) Field of Classification Search
CPC ..... A47L 15/486; A47L 15/488
See application file for complete search history.

(56) References Cited

U.S. PATENT DOCUMENTS 7,216,654 B2 5/2007 Kang
7,798,157 B2 9/2010 Kim
(Continued)

FOREIGN PATENT DOCUMENTS

JP 2001-46309 2/2001
JP 2005-230227 9/2005
(Continued)

OTHER PUBLICATIONS

Korean Office Action dated Nov. 25, 2019 from Korean Patent Application No. 10-2016-0036657, 9 pages.
(Continued)

*Primary Examiner* — Spencer E Bell
(74) *Attorney, Agent, or Firm* — Staas & Halsey LLP

(57) ABSTRACT

A dishwasher capable of shortening drying time is disclosed. The present device comprises: a main body having a washing tub provided therein; a door rotatably coupled to the main body so as to open and close the washing tub; a blowing duct having a passage provided between the outside of the washing tub and the inside of the main body so as to provide a flow path through which the air flowing from the outside flows, and a discharge port provided at the passage so as to spray air to the outside; and a blowing means connected to the blowing duct so as to provide the external air into the blowing duct, and forcibly causing wet steam in the washing tub to flow to the front of the main body, wherein the passage has at least one variable section for changing the cross sectional area thereof.

13 Claims, 16 Drawing Sheets

(56) References Cited

U.S. PATENT DOCUMENTS

| | | | | |
|---|---|---|---|---|
| 8,161,986 | B2 | 4/2012 | Alessandrelli | |
| 2004/0163686 | A1 | 8/2004 | Kang | |
| 2008/0202566 | A1* | 8/2008 | Gonska | A47L 15/0013 134/115 R |
| 2010/0064902 | A1* | 3/2010 | Sakane | F24C 15/327 99/352 |
| 2015/0068510 | A1 | 3/2015 | Lee et al. | |
| 2020/0139714 | A1 | 5/2020 | Kawakami et al. | |

FOREIGN PATENT DOCUMENTS

| | | |
|---|---|---|
| JP | 2008-116094 | 5/2008 |
| KR | 10-0457572 | 11/2004 |
| KR | 10-2006-0104609 | 10/2006 |
| KR | 10-2008-0005249 | 1/2008 |
| KR | 10-2011-0123588 | 11/2011 |
| KR | 10-1202103 | 11/2012 |
| KR | 10-2015-0030016 | 3/2015 |

OTHER PUBLICATIONS

International Search Report dated Jun. 26, 2017 in corresponding International Patent Application No. PCT/KR2017/003098.
Written Opinion of the International Searching Authority dated Jun. 26, 2017 in corresponding International Patent Application No. PCT/KR2017/003098.
Korean Office Action dated Apr. 28, 2020 from Korean Application No. 10-2016-0036657, 7 pages.

* cited by examiner

【Figure 1】
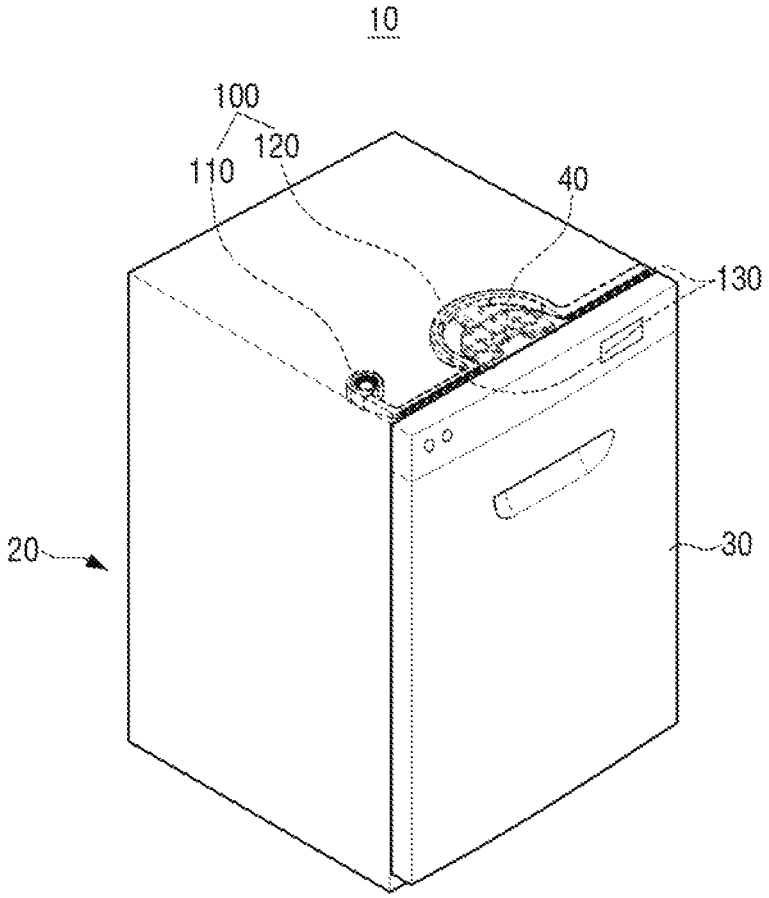

【Figure 2】
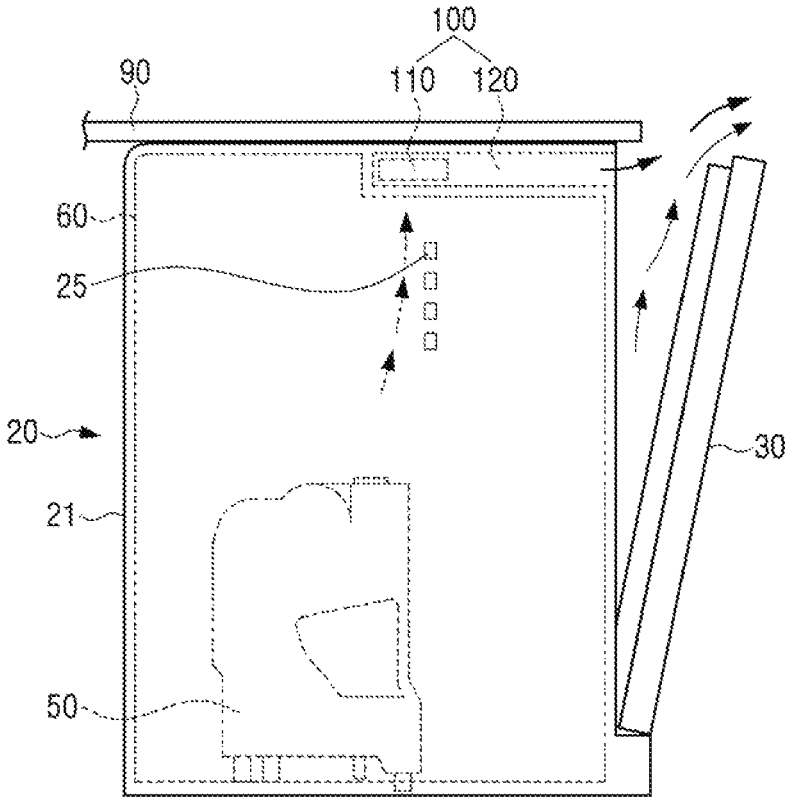

【Figure 3】
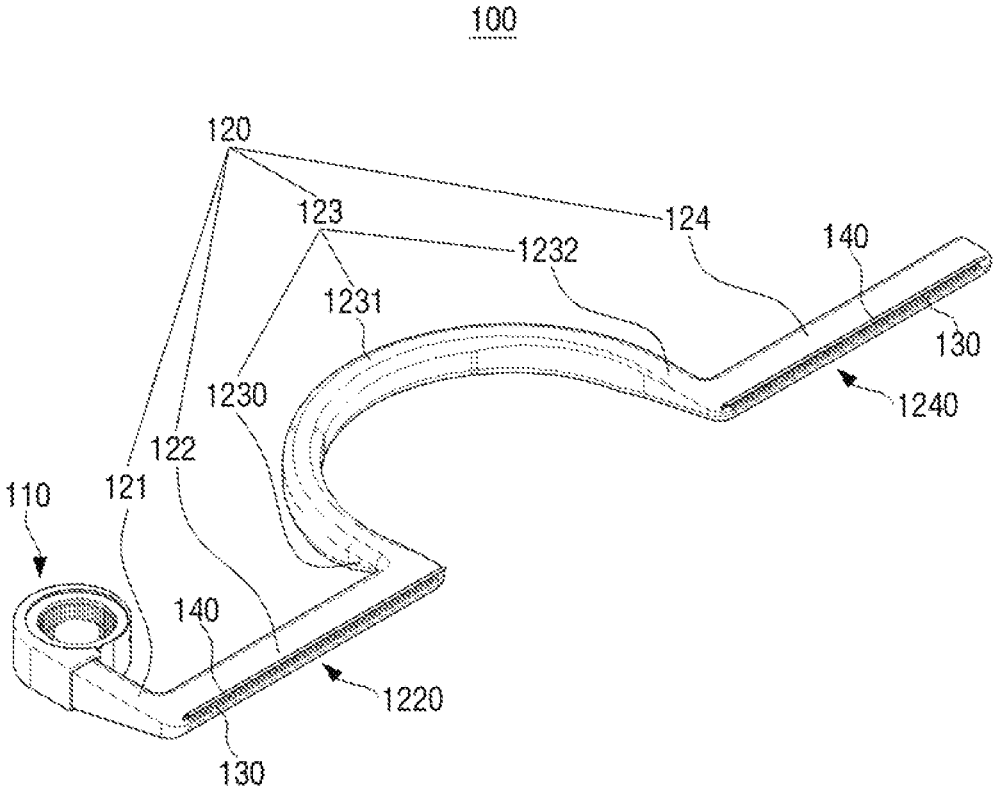

【Figure 4】
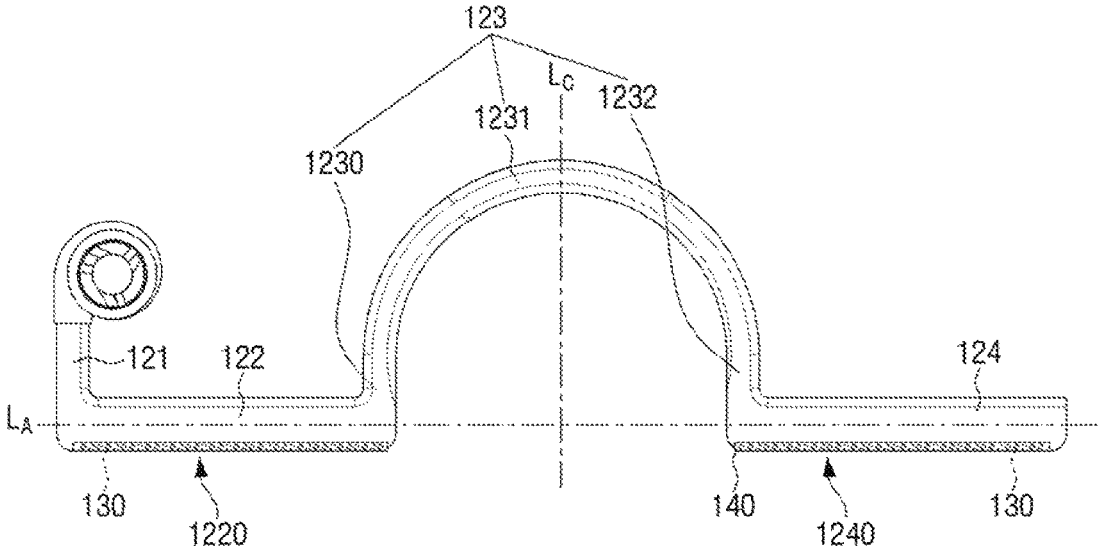

【Figure 5】
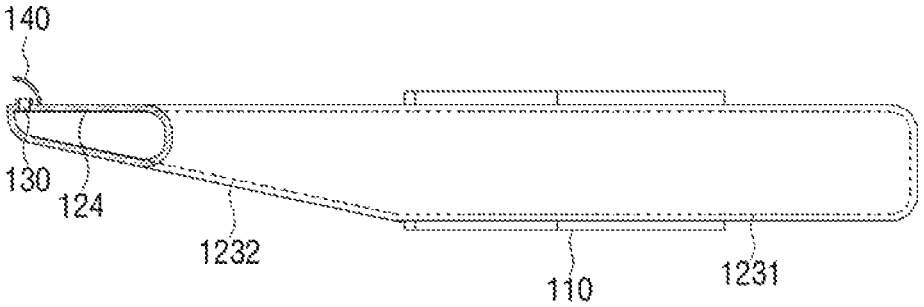

【Figure 6】
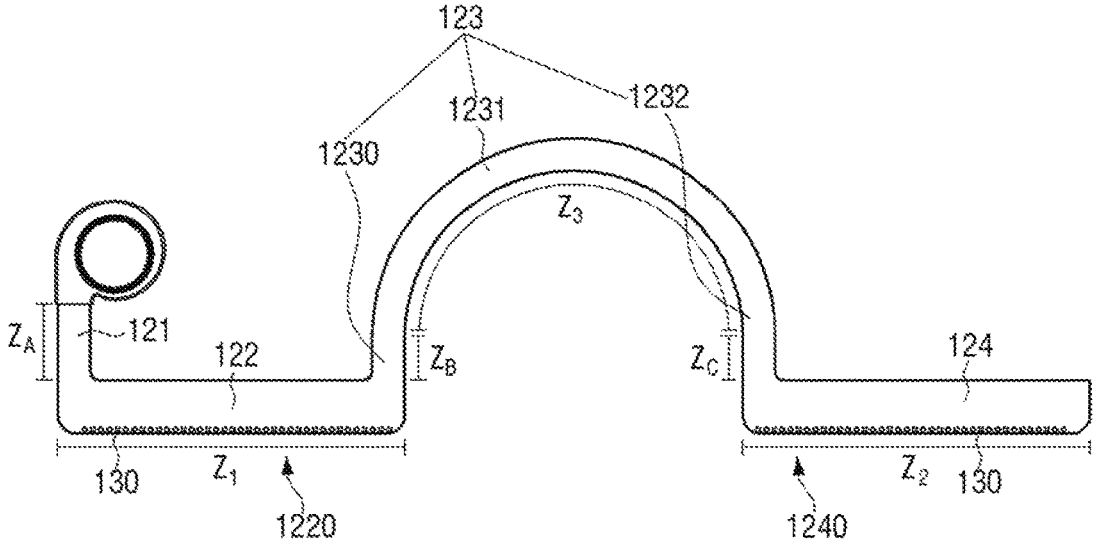

【Figure 7】
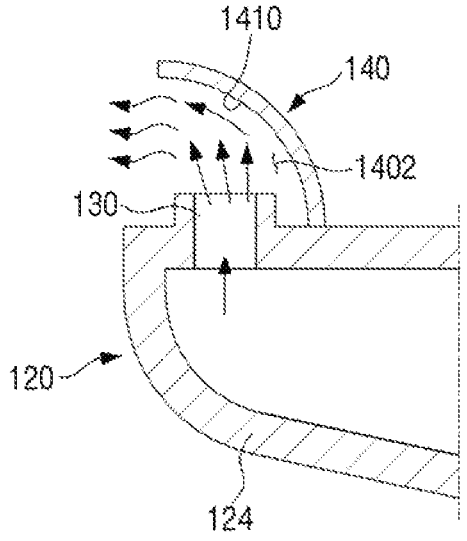

【Figure 8】
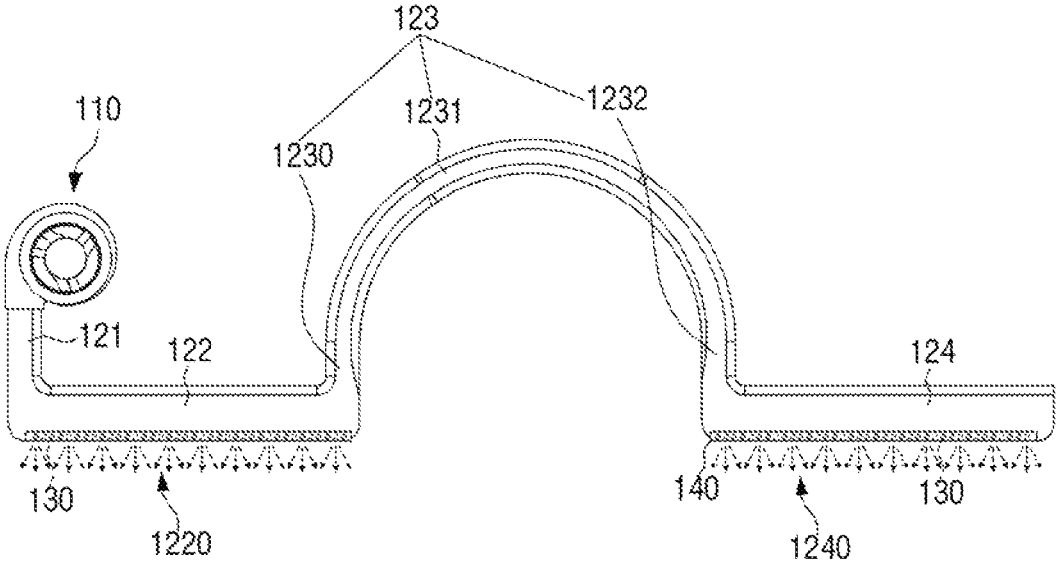

【Figure 9】
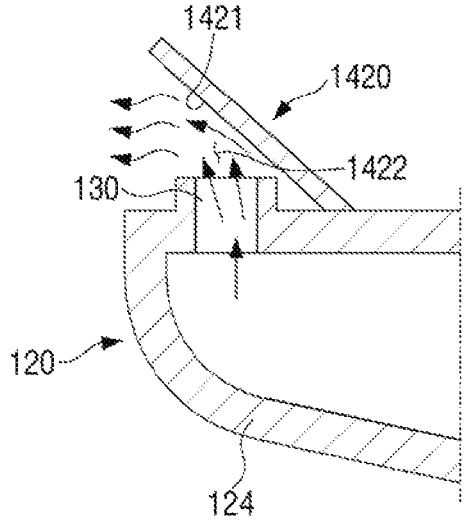

【Figure 10】
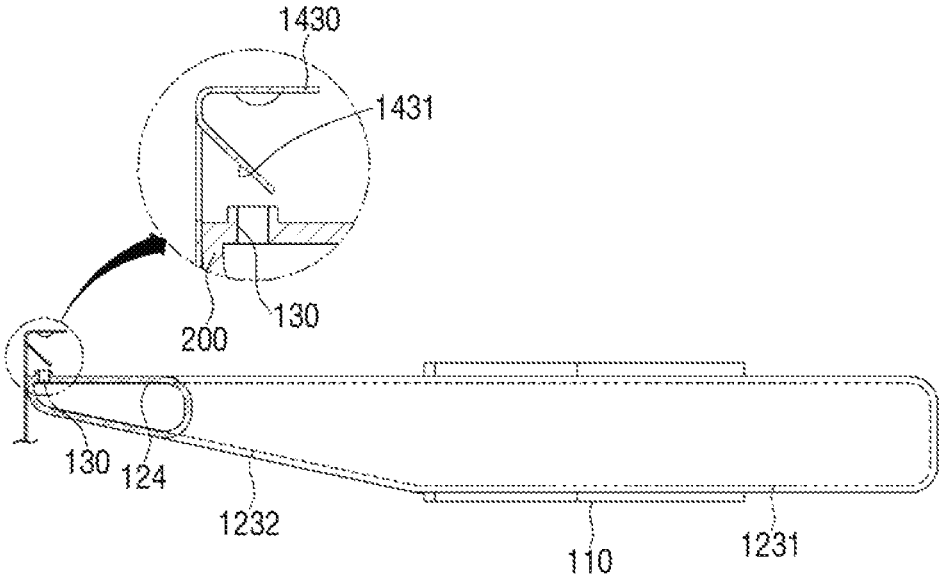

【Figure 11】
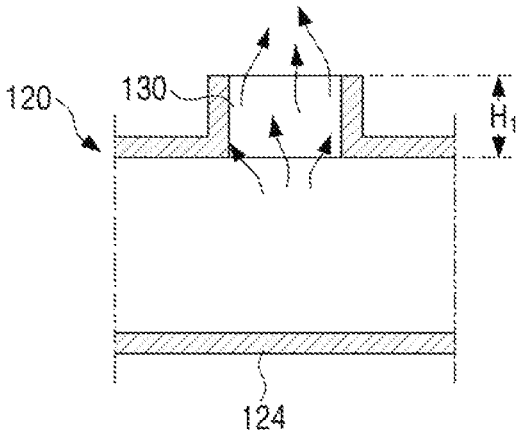

【Figure 12】
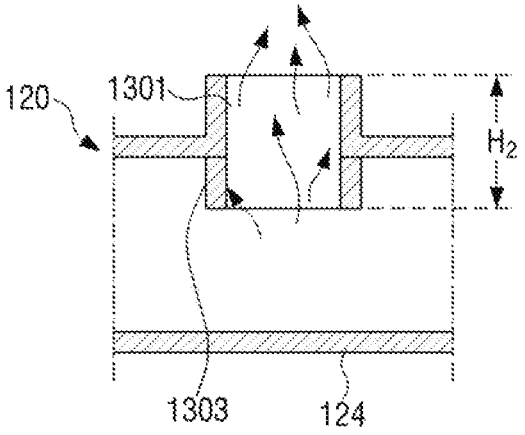

【Figure 13】
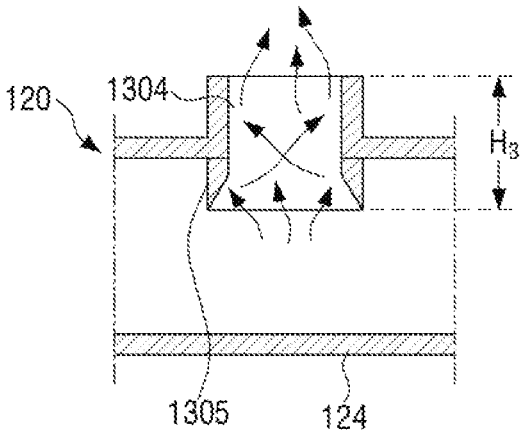

【Figure 14】
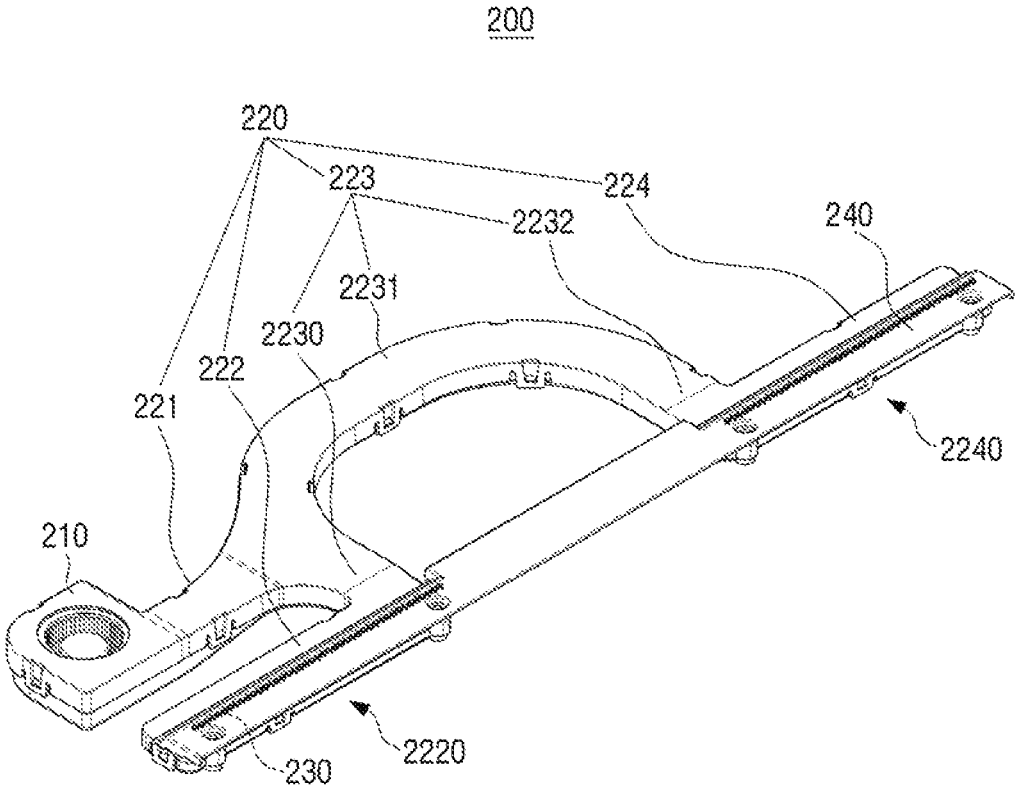

【Figure 15】
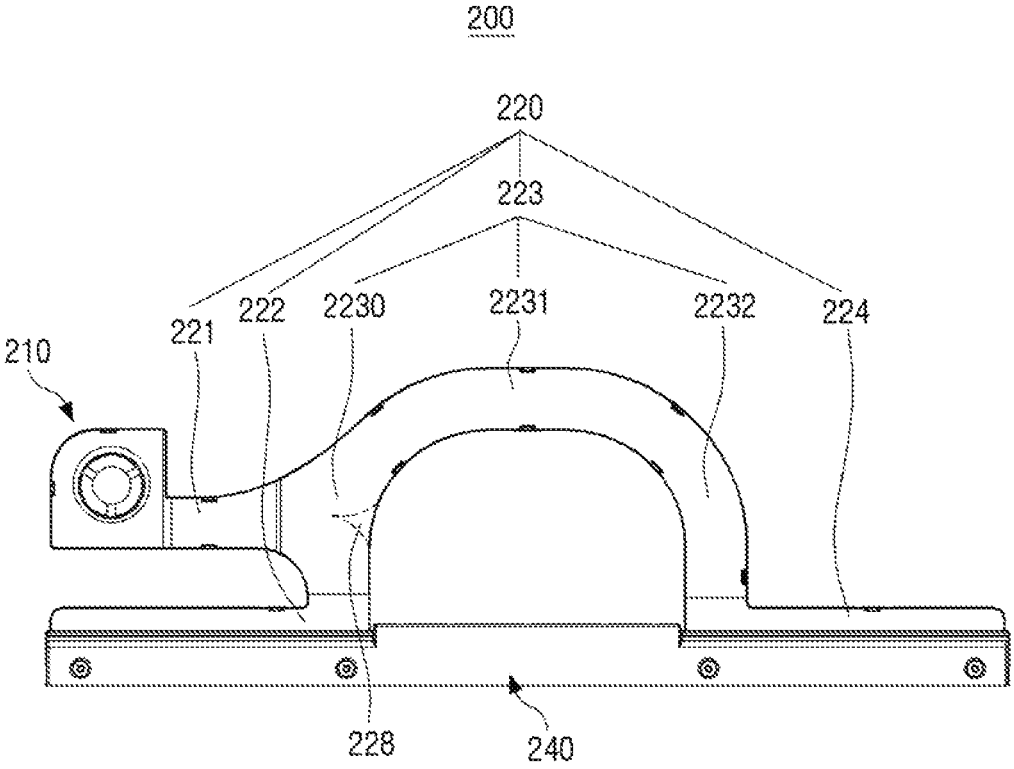

【Figure 16】
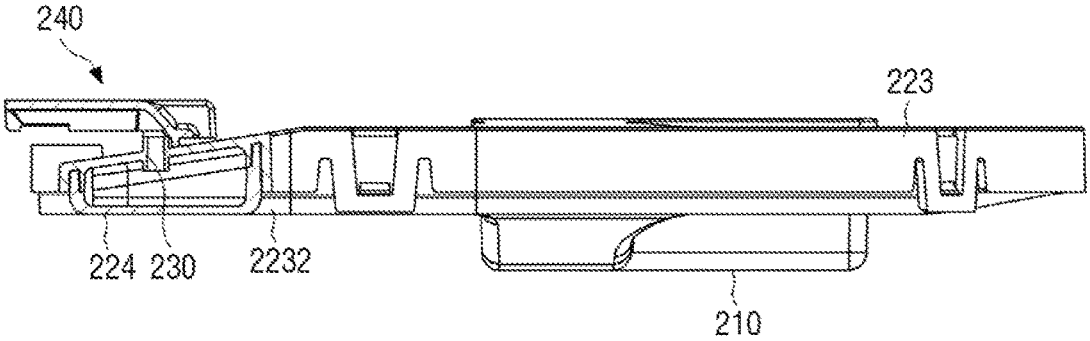

DISHWASHER

CROSS-REFERENCE TO RELATED APPLICATIONS

This application is a National Phase Application under 35 U.S.C. § 371 of PCT International Patent Application No. PCT/KR2017/003098, filed Mar. 23, 2017, which claims the foreign priority benefit under 35 U.S.C. § 119 to Korean Patent Application No. 10-2016-0036657 filed Mar. 28, 2016, the contents of which are incorporated herein by reference.

TECHNICAL FIELD

The present disclosure relates to a dishwasher capable of shortening a drying time of dishes.

BACKGROUND ART

A dishwasher is an apparatus that sprays a high pressure washing water to dishes to thereby wash the dishes. In general, the dishwasher performs preliminary washing, main washing, rinsing, and drying steps. In the preliminary step, the dishwasher sprays the washing water without introducing the cleanser to remove residues of the dishes. In the main washing step, the washing water is sprayed and the cleanser is supplied by a cleanser supplying device so that the dishes are washed.

The dishwasher includes a main body having a washing tank provided therein, a basket holding dishes and movably installed in the washing tank, and spraying nozzles provided at upper and lower portion of the basket and spraying washing water, wherein the washing water sprayed from the spraying nozzles may wash the dishes.

A conventional dishwasher washes the dishes using hot water and then radiates latent heat remaining on the dishes or the like due to the hot water to the outside of the dishes. Such latent heat evaporates water remaining on surfaces of the dishes to thereby dry the dishes, or the dishes are dried by spraying high temperature air to the dishes using a separate heater.

In the case of using the latent heat in the dish drying as described above, a drying time was long, drying efficiency was remarkably low, and a drying condition was not good. In the case of drying the dishes by spraying the high temperature air using the separate heater, there is a problem in that energy consumption is large and electric charges are increased.

DISCLOSURE

Technical Problem

An object of the present disclosure is to provide a dishwasher capable of shortening a drying time of dishes.

Further, a flow of wet stream discharged from the dishwasher may be controlled.

Technical Solution

According to an aspect of the present disclosure, a dishwasher includes a main body configured to have a washing tank provided therein; a door configured to be rotatably coupled to the main body and open and close the washing tank; a blowing duct configured to be installed between an outside of the washing tank and an inside of the main body and have a passage providing a flow path through which air introduced from the outside flows and a discharging port provided in the passage to spray the air to the outside; and a blowing means configured to be connected to the blowing duct to provide external air to the blowing duct, and allow wet steam inside the washing tank to forcedly flow to the front of the main body, wherein the passage has at least one or more variable sections that change a cross-sectional area.

According to another aspect of the present disclosure, a dishwasher includes a main body configured to include a housing, a washing tank being provided in the housing; a door configured to open and close the washing tank; a blowing means configured to suck air from the outside and supply the air to an inside of the housing; a blowing duct configured to have a passage that provides a flow path through which the air supplied from the blowing means flows, and a plurality of discharging ports that spray the air flowing through the passage to the outside of the passage; and a guide member configured to switch a flow direction of the air sprayed through the plurality of discharging ports to the front of the main body and to guide a wet steam discharged from the washing tank to forcedly flow to the front of the main body according to the opening of the door.

DESCRIPTION OF DRAWINGS

FIG. 1 is a perspective view showing a dishwasher according to an embodiment of the present disclosure;

FIG. 2 is a side view showing the dishwasher according to an embodiment of the present disclosure;

FIG. 3 is a perspective view showing a blower according to an embodiment of the present disclosure;

FIG. 4 is a plan view showing the blower according to an embodiment of the present disclosure;

FIG. 5 is a cross-sectional view showing the blower according to an embodiment of the present disclosure;

FIG. 6 is a view illustrating a pressure change in the blower according to an embodiment of the present disclosure;

FIG. 7 is a cross-sectional view showing a guide member according to an embodiment of the present disclosure;

FIG. 8 is a view illustrating a flow direction of wet steam along the guide member according to an embodiment of the present disclosure;

FIG. 9 is a cross-sectional view showing another example of the guide member;

FIG. 10 is a cross-sectional view showing still another example of the guide member;

FIG. 11 is a cross-sectional view showing a discharging port according to an embodiment of the present disclosure;

FIG. 12 is a view showing another example of the discharging port;

FIG. 13 is a view showing still another example of the discharging port;

FIG. 14 is a plan view showing a blower according to another embodiment of the present disclosure;

FIG. 15 is a plan view showing the blower according to another embodiment of the present disclosure; and FIG. 16 is a cross-sectional view showing the blower according to another embodiment of the present disclosure.

BEST MODE

Hereinafter, embodiment of the present disclosure will be described in more detail with reference to FIGS. 1 to 16. The embodiments described below will be described based on embodiments which are most suitable for understanding technical characteristics of the present disclosure, and illustrate that the technical characteristics of the present disclosure are not limited by the embodiments described below, but the present disclosure may be implemented as in the embodiments described below.

Therefore, the present disclosure may be variously modified within a technical scope of the present disclosure through the embodiments described below, and the modified embodiments fall within the technical scope of the present disclosure. In addition, in order to help understanding of the embodiments described below, in the reference numerals indicated on the accompanying drawings, the related components of components which perform the same operation in the respective embodiments are denoted by the same or extension numeral.

Although a dishwasher according to embodiments of the present disclosure will be described as a built-in type that is embedded in a separate installation space between furniture and walls and is used, the dishwasher is not limited thereto and may be applied to a free-standing type that is independently used, not the built-in type.

FIG. 1 is a perspective view showing a dishwasher according to an embodiment of the present disclosure and FIG. 2 is a side view showing the dishwasher according to an embodiment of the present disclosure. Referring to FIGS. 1 and 2, a dishwasher 10 may include a main body 20 forming an outer shape thereof, a washing tank (or a tub) (not shown) provided in the main body 20, a door 30 rotatably installed on the front of the main body 20, a door automatic opening apparatus 40 installed at an upper portion of the door 30, and a blower 100 that sprays air jet when the door 30 is opened.

The main body 20 may include a housing 21 forming the outer shape of the main body 20 and the washing tank 60 may be provided in the housing 21. The blower 100 may be positioned at an outer side of the washing tank 60 and an inner side of the housing 21.

The dishes are accommodated in the washing tank and a washing space of the dishes is formed in the washing tank 60. The washing tank 60 may have an approximately box shape having an opening formed at the front thereof so as to accommodate the dishes. In addition, the dishwasher 10 may include a sump (not shown) in which the washing water is stored at the lower portion of the washing tank 60.

As an example, a storage part of which an upper side is opened to accommodate the dishes may be provided in the washing tank 60, and a dish basket (not shown) may be installed to be movable forward and backward at the upper and lower portions of the washing tank. The dish basket may be pulled out and accommodated through a front surface of the main body 20 which is opened by at least one rack that slide-movably supports the dish basket.

At least one nozzle that sprays the washing water toward the dishes accommodated in the washing tank 60 may be disposed inside the main body 20. In addition, the door automatic opening apparatus 40 may be embedded in the upper portion of the main body 20, and in this case, a tip portion of the door automatic opening apparatus 40 may be positioned to be adjacent to the opening of the door automatic opening apparatus 40 so that the door automatic opening apparatus 40 may open the door 30.

The opening of the washing tank 60 may be opened and closed by the opening 30. As an example, the door 30 is coupled to a lower portion of the front surface of the main body 20 by a hinge and is rotated, thereby making it possible to open and close the washing tank 60. In this case, a knob groove 35 may be formed on the outer surface of the door 30 so that a user may manually open the door 30.

The door automatic opening apparatus 40 may automatically open the door 30 by a predetermined angle in order to discharge a steam inside the main body 20 to the outside and maintain the inside of the washing tank 60 in a dried state when the washing is completed.

The blower 100 includes a blowing duct 120 installed at the upper side of the main body 20 and having discharging ports 130 that spray air jet so that the stream discharged to the outside flows forward, and a blowing means 110 that provide a flow of air to the duct 120.

Hereinafter, the blowing means that provide the air to the blowing duct 120 will be described as a blowing fan 110 as an example, but the blowing means is not limited thereto and may be replaced with an air pump that may provide the air to the blowing duct 120, and the like. Furthermore, the blowing means 110 may also blow the air by adding a duct, a valve, a switch, and the like to the blowing fan (e.g., a hot air generating apparatus for heating and circulating the air in the washing tank (a heater and a blowing fan) which is being used in the dishwasher.

The blowing duct 120 may be embedded in a space portion between the upper portion of the washing tank 60 and the main body 20. The blowing fan 110 is installed between the main body 20 and the washing tank 60 and is positioned to be adjacent to one side surface of the main body 20.

As an example, an air brake 50 may be installed on one side surface of the main body 20. The air brake 50 may be provided with a hole (not shown) which is connected to the washing tank 60 to introduce the air into the washing tank 60 or discharge the air from the washing tank 60.

The blowing fan 110 may be installed at an upper portion of the air brake 50. The main body 20 may be provided with a connecting hole 25 that connects the outside and the main body 20 with each other, and the connecting hole 25 may be positioned between the blowing fan 110 and the air brake 50. The blowing fan 110 may be a centrifugal fan for supplying the air introduced from the outside to the blowing duct 120.

When the centrifugal fan is used as the blowing fan 110, the centrifugal fan may suck the outside air introduced through the connecting hole 25 and supply it to the blowing duct 120. In addition, since the centrifugal fan may suck and discharge hot and humid steam in the washing tank 60 discharged through the air brake 50, there is an advantage that moisture in the air brake 50 may be easily removed.

Further, since a space between the main body 20 and the washing tank 60 that have an approximately box shape may be minimized, space usage efficiency may be improved. In addition, a predetermined flow velocity of air may be maintained by effectively supplying the air to the inside of the blowing duct 120.

In particular, in a case in which the blowing fan 110 is installed at one side, the blowing fan 110 uses the same power source as that of a driving part that drives the door automatic opening apparatus 40, thereby having an advantage that a separate power application apparatus does not need to be provided.

The blowing fan 110 is not limited to the centrifugal fan, and an axial-flow fan or a tangential fan is used to be positioned at corner portions of the main body 20 and the washing tank 60, thereby making it possible to flow the air to the blowing duct 120.

The blowing duct 120 is positioned at one side of the blowing fan 110 and the air sucked through the blowing fan 110 is introduced into the blowing duct 120. The blowing duct 120 may have the discharging ports 130 that spray the air supplied through the blowing fan 110. The blowing duct 120 may be installed on the same plane as the door automatic opening apparatus 40, and in this case, the discharging ports 130 may be positioned at both sides of the door automatic opening apparatus 40, respectively.

FIG. 3 is a perspective view showing a blower according to an embodiment of the present disclosure and FIG. 4 is a plan view showing the blower according to an embodiment of the present disclosure. In addition, FIG. 5 is a cross-sectional view showing the blower according to an embodiment of the present disclosure.

Referring to FIGS. 3 to 5, the blowing fan 110 may be disposed at one side of the blowing duct 120. The blowing duct 120 may have passages 121, 122, 123, and 124 that provide flow paths through which the air introduced through the blowing fan 110 flows, and the discharging ports 130 that spray the air to the outside may be formed in first and second passages 122 and 124 positioned in the front of the blowing duct 120.

As an example, an introduction passage 121 may be connected to the blowing fan 110 and the first passage 122. The air sucked by the blowing fan 110 may flow through the introduction passage 121. The introduction passage 121 may have a shape in which a cross-sectional area is decreased toward the first passage 122. That is, the introduction passage 121 has the shape in which the cross-sectional area is decreased, thereby making it possible to increase a flow velocity of the air sucked by the blowing fan 110 and to supply it to the first passage 122.

The first passage 122 positioned at one side in relation to the door automatic opening apparatus 40 (FIG. 1) may be provided with a first spraying part 1220, and the second passage 124 positioned at the other side in relation to the door automatic opening apparatus 40 may be provided with a second spraying part 1240. The first passage 122 and the second passage 124 may be positioned on the same plane and may be put on the same center axis $L_A$.

A connection passage 123 may be positioned between the first passage 122 and the second passage 124 and may be connected to the first passage 122 and the second passage 124, respectively. The first passage 122 may have a predetermined cross-sectional area and the second passage 124 may have a cross-sectional area corresponding to that of the first passage 122. The connection passage 123 has variable sections 1230 and 1232 that change the cross-sectional area through which the air flows.

The connection passage 123 includes a first connection passage 1230 which is connected to the first passage 122, and a second connection passage 1232 which is connected to the second passage 124. The first connection passage 1230 may have a shape in which one end portion thereof is connected to the first passage 122 and a cross-sectional area is increased toward the other end portion thereof. The second connection passage 1232 may have one end portion which is connected to the other end portion of the first connection passage 1230 and the other end portion which is connected to the second passage 124. The second connection passage 1232 may have a shape in which a cross-sectional area is decreased toward the other end portion thereof.

The connection passage 123 may further include a third connection passage 1231 which is connected to the first connection passage 1230 and the second connection passage 1232. One end portion and the other portion of the third connection passage 1231 may be connected to the first connection passage 1230 and the second connection passage 1232, respectively, and the third connection passage 1231 may have a constant cross-sectional area. The first passage 122 and the second passage 124 may have a bilateral symmetry structure in relation to a virtual line $L_C$ passing through a center of the connection passage 123.

The first connection passage 1230 has the shape in which the cross-sectional area is increased toward the third connection passage 1231, such that a flow velocity of air flowing from the first connection passage 1230 to the third connection passage 1231 is decreased. Since the third connection passage 1231 has the constant cross-sectional area along a length direction, a flow velocity of air is constantly maintained. Since the second connection passage 1232 has the shape in which the cross-sectional area is decreased toward the second passage 124, a flow velocity of air flowing from the second connection passage 1232 to the second passage 124 is increased.

Therefore, by providing a uniform flow of air to the first passage 122 and the second passage 124 through the connection passage 123, a deviation of air discharged through the discharging ports 130 formed in the first spraying part 1220 and the second spraying part 1240 may be minimized.

Further, the connection passage 123 may have a curved shape (a '∩' shape) so as to be connected to the first passage 122 and the second passage 124, respectively. The connection passage 123 has a structure capable of minimizing the deviation in the flow rate of air flowing through the first passage 122 and the second passage 124 without interfering with the door automatic opening apparatus 40.

As an example, the first connection passage 1230 may be positioned to be perpendicular to the first passage 122, and the second connection passage 1232 may be positioned to be perpendicular to the second passage 124. In addition, the third connection passage 1231 having a curved shape may connect the first connection passage 1230 and the second connection passage 1232 with each other.

If necessary, the user may minimize the flow rate of the air flowing through the first passage 122 and the second passage 124 by varying the cross-sectional area and a ratio of the flow rate of the connection passage 123. When a cross-sectional area of a flow path is increased, a resistance is decreased and a flow rate is increased, thereby making it possible to increase a discharged flow rate and a discharged flow velocity.

FIG. 6 is a view illustrating a pressure change in the blower according to an embodiment of the present disclosure. Referring to FIG. 6, each of the passages 121, 122, 123, and 124 may be divided into sections to know a pressure change through the principle of Bernoulli. When air (fluid) flowing the passages 121, 122, 123, and 124 flows through a portion in which a cross-sectional area is large and a portion in which a cross-sectional area is small, a flow of air is slow and a pressure of air is high in the portion in which the cross-sectional area is large, and the flow of air is fast and the pressure of air is low in the portion in which the cross-sectional area is small.

That is, since the introduction passage 121 (an introduction variable section $Z_A$) has a shape in which a cross-sectional area is decreased toward the first passage 122 (a first section $Z_1$), a flow of air is fast and a pressure is decreased in the introduction passage 121. In addition, since the first connection passage 1230 (a first variable section $Z_B$) has a shape in which a cross-sectional area is increased toward the third connection passage 1231 (a third section $Z_3$), the flow of air is slow and the pressure is high in the first connection passage 1230. Since the second connection passage 1232 (a second variable section $Z_C$) has a shape in which a cross-sectional area is decreased toward the second passage 124 (a second section $Z_2$), the flow of air is fast and the pressure is decreased in the second connection passage 1232. In addition, since the first section $Z_1$ and the second section $Z_2$ have the same cross-sectional area along the length direction, the flow of air and the change in the pressure are maintained in the first section $Z_1$ and the second section $Z_2$.

That is, the first to third connection passages 1230, 1232, and 1231 provided in the connection passage 123 adjust the flow of air flowing from the first passage 122 to the second passage 124, thereby making it possible to minimize spraying pressures of the first spraying part 1220 and the second spraying part 1240 positioned in the first passage 122 and the second passage 124. Therefore, when the door 30 is opened, a deviation in a spraying amount of the first spraying part 1220 and the second spraying part 1240 is minimized, thereby making it possible to effectively disperse wet steam discharged from the inside of the washing tank 60 toward the front.

In addition, the first passage 122 and the second passage 124 may have a shape in which a cross-sectional area is decreased toward the front at which the discharging ports 130 are positioned. That is, the air flowing through the first passage 122 and the second passage 124 may increase the flow velocity thereof toward the discharging ports 130 and may be discharged to the outside.

FIG. 7 is a cross-sectional view showing a guide member according to an embodiment of the present disclosure and FIG. 8 is a view illustrating a flow direction of wet steam along the guide member according to an embodiment of the present disclosure. Referring to FIGS. and 8, the dishwasher 10 may further include a guide member 140 capable of switching a direction of the air sprayed through the discharging ports 130 toward the front of the main body. The guide member 140 may be positioned on the first spraying part 1220 and the second spraying part 1240, respectively. The guide member 140 may be injection-molded integrally with the blowing duct 120, but is not limited thereto, and may be connected to the blowing duct 120 by a separate fastening means.

The guide member 140 may determine a spraying direction and angle of the air sprayed through the discharging ports 130. As an example, the discharging ports 130 may be provided on upper surfaces of the first passage 122 and the second passage 124, and may be positioned in the first passage 122 and the second passage 124 to be spaced apart from each other by a predetermined interval. In addition, a case in which the discharging port 130 is positioned so that a spraying direction is directed to the guide member 140 is described as an example, but the discharging port 130 is not limited thereto and may be provided so as to spray upwardly the air at a constant angle.

In this case, the guide member 140 may be provided on the passage. One end portion of the guide member 140 may be connected to an upper surface of the blowing duct 120 and the other end portion of the guide member 140 may be positioned to be spaced apart from the upper portions of the discharging ports 130 by a predetermined interval. The guide member 140 may have a concave shape so that an opposite surface 1410 facing the discharging ports 130 is upwardly inclined toward the front, and may protrude to the front of the discharging ports 130 to accommodate the discharging ports 130, thereby forming an accommodating space 1402.

That is, the guide member 140 may be positioned in upper portions of the discharging ports 130 to thereby control the spraying direction of air through the opposite surface 1410 facing the air sprayed upwardly. In particular, since the opposite surface 1410 has the concave shape toward the front, the guide member 140 may minimize a resistance of the air sprayed through the discharging ports 130 to prevent the flow velocity of the air from being decreased.

Therefore, when the door 30 is opened, the guide member 140 may flow the wet steam inside the washing tank 60 toward the front. Furthermore, since the air discharged through the discharging ports 130 is guided and dispersed along the opposite surface 1410 of the guide member 140, there is an advantage that the air may be sprayed evenly and uniformly toward the front.

FIG. 9 is a cross-sectional view showing another example of the guide member. Hereinafter, a difference from the guide member described in FIGS. 1 to 8 will be mainly described, and an omitted description may be replaced with the contents described above. Referring to FIG. 9, guide members 1420 may be positioned on the discharging ports 130 and may be positioned in the first spraying part 1220 and the second spraying part 1240, respectively.

One end portion of the guide member 1420 may be connected to an upper surface of the blowing duct 120 and the other end portion of the guide member 1420 may be positioned to be spaced apart from upper ends of the discharging ports 130 by a predetermined interval. The guide member 1420 may have a linear shape in which opposite surface 1421 facing the discharging ports 130 is upwardly inclined toward the front, and may form an accommodating space 1422 to accommodate the discharging ports 130.

That is, the guide member 1420 may be positioned on the discharging ports 130 to thereby control the spraying direction of air through the opposite surface 1421 facing the air sprayed upwardly. The user may adjust a spraying angle of air discharged through the discharging ports 130 by adjusting an upwardly inclined angle of the guide member 1420. Furthermore, since the air discharged through the discharging ports 130 is guided and dispersed along the opposite surface 1421 of the guide member 1420, the air may be sprayed evenly and uniformly toward the front.

FIG. 10 is a cross-sectional view showing still another example of the guide member. Hereinafter, a difference from the guide member described in FIGS. 1 to 9 will be mainly described, and an omitted description may be replaced with the contents described above. Referring to FIG. 10, a guide member 1430 may be provided by bending a portion of the main body 20.

As an example, the guide member 1430 may be provided by cutting a portion of an upper portion of a front surface of the main body 20 and bending a cut surface 1431 toward the discharging port 130. The cut surface 1431 may be positions corresponding to the first spraying part 1220 and the second spraying part 1240.

In a case in which a lower end of the cut surface 1431 of the guide member 1430 is positioned behind the discharging port 130, the opposite surface having the shape corresponding to that of FIG. 9 may be provided. Furthermore, the cut surface 1431 of the guide member 1430 may be bent in a concave shape toward the front to thereby provide the opposite surface having the shape corresponding to that of FIG. 8.

In this case, since the guide member 1430 is provided by bending the portion of the main body 20, it is possible to prevent an increase in the unit price due to the material consumed additionally and it is possible to improve productivity and efficiency by providing simplicity of a product production. Meanwhile, when the guide member 1430 is provided by bending the main body 20, a height at which the blowing duct 120 is installed between the outside of the washing tank 60 and the inside of the main body 20 may be changed by a selection of the user.

FIG. 11 is a cross-sectional view showing a discharging port according to an embodiment of the present disclosure. Referring to FIG. 11, the discharging port 130 may be connected to a passage through which air flows, and may protrude upwardly from the blowing duct 120. As an example, an upper end of the discharging port 130 may have a predetermined height $H_1$ from an inner wall of the second passage 124. As the discharging port 130 has the predetermined height, the discharging port 130 may induce an irregular flow of the air discharged from the second passage 124 through the discharging part 130 and may primarily disperse the air discharged toward the guide member 140.

FIG. 12 is a cross-sectional view showing another example of the discharging port and FIG. 13 is a cross-sectional view showing still another example of the discharging port. Hereinafter, a difference from the discharging port described in FIG. 11 will be mainly described and an omitted description may be replaced with the contents described in FIG. 11.

Referring to FIG. 12, a discharging port 1301 may be connected to the second passage 124 through which the air flows, and may protrude upwardly from the blowing duct 120. As an example, extensions 1303 may be provided to inner walls of the second passage 124 and the extensions 1303 may be positioned at upper inner walls of the second passage 124 so as to be connected to the discharging port 1301. The extensions 1303 may be a cylindrical shape having the same center axis and inner diameter.

That is, a distance between a lower end of the extension 1303 and an upper end of the discharging port 1301 may have a predetermined height H2, and when the air flowing through the second passage 124 is discharged through the discharging port 1301, a flow distance of the air is increased.

Referring to FIG. 13, inner circumference surface of extensions 1305 may have a tapered shape. The extensions 1305 may be provided to the inner walls of the second passage 124 and a distance between a lower end of the extension 1305 and an upper end of the discharging port 1304 may have a predetermined height $H_3$. That is, the inner circumferential surfaces of the extensions have the tapered shape, thereby making it possible to increase a flow distance that the air flowing through the second passage 124 is discharged through the discharging port 1304, and to minimize a decrease in a flow velocity of the discharged air.

Therefore, the discharging port 1304 may induce an irregular flow of the air discharged from the second passage 124 through the discharging port 1304 by the increased flow distance and may primarily disperse the air discharged toward the guide member 140. The air that is primarily dispersed through the discharging port 1304 may be secondarily dispersed to the guide member 140. The wet steam inside the washing tank 60 upwardly discharged may be uniformly discharged to the front by the uniformly dispersed air.

FIG. 14 is a perspective view showing a blower according to another embodiment of the present disclosure and FIG. 15 is a plan view showing the blower according to another embodiment of the present disclosure. In addition, FIG. 16 is a cross-sectional view showing the blower according to another embodiment of the present disclosure. Hereinafter, a difference from the blower described in FIGS. 1 to 13 will be mainly described, and an omitted description may be replaced with the contents described above.

Referring to FIGS. 14 to 16, a blower 200 may include a blowing duct 220 installed at an upper side of the main body 20 and having discharging ports 230 that sprays air jet so that steam discharged to the outside flows forward, and a blowing fan 210 that provides a flow of air to the blowing duct 220.

The blowing fan 210 may be disposed at one side of the blowing duct 220. The blowing duct 220 may have passages 221, 222, 223, and 224 that provide flow paths through which the air introduced through the blowing fan 210 flows, and the discharging ports 230 that spray the air to the outside may be formed in first and second passages 222 and 224.

As an example, an introduction passage 221 may be connected to the blowing fan 210 and a connection passage 223. The air sucked by the blowing fan 210 may flow through the introduction passage 221. The introduction passage 221 may have a shape in which a cross-sectional area is decreased toward the connection passage 223. That is, the introduction passage 221 has the shape in which the cross-sectional area is decreased, thereby making it possible to increase a flow velocity of the air sucked by the blowing fan 210 and to supply it to the connection passage. The introduction passage 221 may be connected to a third connection passage 2231 to be described below, thereby minimizing an installation area of the blower.

A guide wall 228 may be provided in the connection passage 223. The guide wall 228 may be connected to an inner wall of the connection passage 223 and may guide the air introduced through the introduction passage 221 to uniformly flow to the first passage 222 and the second passage 224. The guide wall 228 may have a shape protruding toward the introduction passage 221 and may have a constant curvature so that a flow of air flowing through the first passage 222 and the second passage 224 is smooth.

The first passage 222 positioned at one side in relation to the door automatic opening apparatus 40 (FIG. 1) may be provided with a first spraying part 2220, and the second passage 224 positioned at the other side in relation to the door automatic opening apparatus 40 may be provided with a second spraying part 2240. The first passage 222 and the second passage 224 may be positioned on the same plane and may be put on the same center axis.

The connection passage 223 may be positioned between the first passage 222 and the second passage 224 and may be connected to the first passage 222 and the second passage 224, respectively. The first passage 222 may have a predetermined cross-sectional area and the second passage 224 may have a cross-sectional area corresponding to that of the first passage 222. The connection passage 223 has variable sections 2230 and 2232 that change the cross-sectional area through which the air flows.

The connection passage 223 includes a first connection passage 2230 which is connected to the first passage 222, and a second connection passage 2232 which is connected to the second passage. The first connection passage 2230 may have a shape in which one end portion thereof is connected to the first passage 222 and a cross-sectional area is increased toward the other end portion thereof. The second connection passage 2232 may have one end portion which is connected to the other end portion of the first connection passage 2230 and the other end portion which is connected to the second passage 224. The second connection passage 2232 may have a shape in which a cross-sectional area is decreased toward the second passage 224.

The connection passage 223 may further include a third connection passage 2231 which is connected to the first connection passage 2230 and the second connection passage 2232. One end portion and the other portion of the third connection passage 2231 may be connected to the first connection passage 2230 and the second connection passage 2232, respectively, and the third connection passage 2231 may have a constant cross-sectional area. The first passage 222 and the second passage 224 may have a bilateral symmetry structure in relation to a virtual line passing through a center of the connection passage 223.

The first connection passage 2230 has the shape in which the cross-sectional area is increased toward the third connection passage 2231, such that a flow velocity of air flowing from the first connection passage 2230 to the third connection passage 2231 is decreased. Since the third connection passage 2231 has the constant cross-sectional area along a length direction, a flow velocity of air is constantly maintained. Since the second connection passage 2232 has the shape in which the cross-sectional area is decreased toward the second passage 224, a flow velocity of air flowing from the second connection passage 2232 to the second passage 224 is increased.

Therefore, by providing a uniform flow of air to the first passage 222 and the second passage 224 through the connection passage 223, a deviation of air discharged through the discharging ports 230 formed in the first spraying part 2220 and the second spraying part 2240 may be minimized.

Further, the connection passage 223 may have a curved shape (a '∩' shape) so as to be connected to the first passage 222 and the second passage 224, respectively. The connection passage 223 has a structure capable of minimizing the deviation in the flow rate of air flowing through the first passage 222 and the second passage 224 without interfering with the door automatic opening apparatus 40 (FIG. 1).

As an example, the first connection passage 2230 may be positioned to be perpendicular to the first passage 222, and the second connection passage 2232 may be positioned to be perpendicular to the second passage 224. In addition, the third connection passage 2231 having a curved shape may connect the first connection passage 2230 and the second connection passage 2232 with each other.

That is, the first to third connection passages 2230, 2232, and 2231 provided in the connection passage 223 adjust the flow of air flowing from the first passage 222 to the second passage 224, thereby making it possible to minimize spraying pressures of the first spraying part 2220 and the second spraying part 2240 positioned in the first passage 222 and the second passage 224. Therefore, when the door 40 is opened, a deviation in a spraying amount of the first spraying part 2220 and the second spraying part 2240 is minimized, thereby making it possible to effectively disperse wet steam discharged from the inside of the washing tank 60 toward the front.

In addition, the first passage 222 and the second passage 224 may have a shape in which a cross-sectional area is decreased toward the front at which the discharging ports 230 are positioned. That is, the air flowing through the first passage 222 and the second passage 224 may increase the flow velocity thereof toward the discharging ports 230 and may be discharged to the outside. Further, linear sections of the first passage 222 and the second passage 224 may also be increased so that the air discharged through the discharging ports 230 may be uniformly discharged. As well, corner portion of a top surface and a bottom surface in which the flow paths are formed may also be formed to be inclined at a predetermined angle or may also be formed (e.g., chamfered) in a curved surface.

The guide member 240 may be provided on the blowing duct 220 so that an opposite surface facing the discharging ports 230 is positioned on the discharging ports 230. One end portion of the guide member 240 connected to an upper surface of the blowing duct 220 may be positioned to be upwardly inclined toward the front, and the other end portion of the guide member 240 may be positioned to be substantially in parallel along a horizontal direction. In this case, one end portion of the guide member 240 which is upwardly inclined toward the front may be positioned on the discharging ports 230.

In addition, the other end portion of the guide member 240 may protrude to the front of the discharging ports 230. The guide member 240 may be removably fastened to the blowing duct 220. For example, the guide member 240 and the blowing duct 220 may be coupled to each other by a bolt, and a fastening method between the guide member 240 and the blowing duct 220 is not limited thereto. In this case, the discharging ports 230 may be positioned at the front or the rear of a fastening part so as not to be interfered with the guide member 240. Further, the opposite surface of the guide member 240 may be modified to various shapes described above.

As described above, the dishwasher 10 described with reference to the embodiments of the present disclosure may easily discharge the wet steam inside the washing tank 60 to the front surface. A washing operation (a washing and rinsing operation) of the dishwasher 10 is divided into a main operation and a preliminary operation and is repeatedly performed according to a course, and a last rinsing is generally performed by using a hot temperature washing water. For example, the main washing operation after the preliminary washing operation may be performed, and the rinsing operation may be performed, a high temperature rinsing operation may be performed, and a drying operation may be then performed.

In the conventional dishwasher, the last rinsing starts to allow a temperature of the washing water to arrive at a target temperature at the time of the end of the last rinsing, and the washing water is heated by operating a heater from a point of time at which a predetermined time elapses. If the rinsing is completed, the drying operation starts, and conventionally, the drying operation is performed for a long time in a method of operating a fan installed in the main body to forcedly discharge wet steam inside the washing tank.

As another example of the drying operation, by using a high temperature water for washing and rinsing and increasing the temperature inside the dishwasher, an evaporation of wet dishes during the washing and rinsing is prompted, or evaporated water vapor is condensed in a drying (or a heat exchange) duct or removed using a moisture absorbent. Alternatively, the condensation and moisture absorbent by the drying (or heat exchange) duct are also used together.

The conventional dishwasher described above has an increased time required to wash the dishes due to drying time of about 30 minutes or more, and therefore, there is a problem that energy consumed in the drying operation is increased. In addition, in some methods, drying efficiency is significantly deteriorated and a drying condition is poor.

The dishwasher 10 according to an embodiment of the present disclosure may have a drying operation when a rinsing operation is completed. Before the rinsing operation, the washing operation and the rinsing operation may be first performed. Next, since a high temperature rinsing (HR) is performed at the last step of the rinsing, a latent drying is performed for a predetermined time in a high temperature internal atmosphere and the door 30 is opened at a predetermined angle through the door automatic opening apparatus 40.

In this case, the blowing fan 110 is operated to spray external air through the discharging ports 130 formed in the blowing duct 120. That is, when a high temperature and humidity wet steam inside the washing tank is discharged upwardly through the door 30, an air curtain is formed through the air flowing toward the front. Therefore, it is possible to prevent the wet steam from flowing upwardly, and it is possible to prevent foreign materials (dust and the like) introduced from the outside from being again introduced into the inside of the washing tank 60 in advance.

The operation of the blowing fan 110 may be controlled through a controller (not shown) which is separately connected. An operation timing of the blowing fan 110 is not limited to only when the door 30 is opened, but the blowing fan 110 may be operated immediately after the drying operation.

As another example, at a timing before the door 30 is opened by the door automatic opening apparatus 40 after the drying operation starts, the blowing fan 110 may be operated. In this case, since the blowing fan may suck and discharge the humid air in the washing tank 60 discharged through the air brake 50, there is an advantage that moisture in the air brake 50 may be easily removed.

Further, unlike the conventional long drying time, the blower 100 is implemented to quickly discharge the wet steam in the washing tank 60 to the outside, thereby making it possible to shorten the drying time and to improve efficiency.

That is, the blower 100 described with reference to the embodiments of the present disclosure may prevent the wet steam discharged when the door 30 is opened from being upwardly discharged in order to shorten the drying time of the dishwasher 10. In particular, a built-in type dishwasher 10 which is embedded in a separated installed space and is used may minimize the damage caused by a high temperature steam on household appliances and wooden furniture located at the upper portion thereof.

Further, in a case in which the blowing fan 110 is provided to one side of the door automatic opening apparatus 40, the blowing fan 110 may be operated by applying a current by the same power line as that of an actuator (not shown), it is not necessary to configure to a separate power controller. As well, the blower 100 is provided between the main body 20 and the washing tank 60, thereby making it possible to minimize a change in a structure of the dishwasher 10.

The forms of the blowing duct 120 and the passages provided in the blowing duct are not limited to those described above. The blowing means 110 may be positioned at one side of the blowing duct 120, or may also be positioned at both side of the blowing duct 120 by additionally providing a separate blowing means 110. In addition, the discharge ports 130 may be formed on the front surface of the blowing duct 120 by changing the position of the blowing duct 120 to be installed on the door automatic opening apparatus 40.

Hereinabove, although diverse embodiments of the present disclosure are individually described, each of the embodiments is not necessarily implemented alone, and the configuration and operation of each of the embodiments may be implemented in combination with at least one other embodiments.

In addition, hereinabove, although the embodiments of the present disclosure have been shown and described, it should be understood that the present disclosure is not limited to the disclosed embodiments and may be variously changed without departing from the spirit and the scope of the present disclosure. Therefore, the present disclosure should be construed as including all the changes, equivalents, and substitutions included in the spirit and scope of the present disclosure.

The invention claimed is:

1. A dishwasher comprising:

a main body configured to have a washing tank provided therein;

a door configured to be rotatably coupled to the main body to open and close the washing tank;

a blowing duct configured to be installed between an outside of the washing tank and an inside of the main body and having a passage providing a flow path through which air introduced from the outside flows and discharging ports provided in the passage to spray the air to the outside; and a blowing fan configured to be connected to the blowing duct to provide external air to the blowing duct, and to allow wet steam inside the washing tank to forcedly flow to the front of the main body, wherein the passage has at least one or more variable sections that change a cross-sectional area, wherein the blowing duct has:

a first spraying part that sprays the air through the discharging ports formed at one side of the passage; and a second spraying part that sprays the air through the discharging ports formed at the other side of the passage and is positioned to be spaced apart from the first spraying part, wherein the passage includes:

a first passage having the first spraying part;

a second passage having the second spraying part; and a connection passage which connects the first passage and the second passage in series, and wherein the first passage and the second passage are positioned on the same center axis, and the connection passage has a curved shape.

2. The dishwasher as claimed in claim 1, wherein the first passage has a predetermined cross-sectional area, wherein the second passage has a cross-sectional area corresponding to that of the first passage, and wherein the connection passage has the at least one or more variable sections.

3. The dishwasher as claimed in claim 2, wherein the first passage and the second passage have a bilateral symmetry structure in relation to a center of the connection passage.

4. The dishwasher as claimed in claim 2, wherein the connection passage includes:

a first connection passage having one end portion which is connected to the first passage and having a shape in which a cross-sectional area is increased toward another end portion; and a second connection passage having one end portion which is connected to the other end portion of the first connection passage and another end portion which is connected to the second passage, and having a shape in which a cross-sectional area is decreased toward the second passage.

5. The dishwasher as claimed in claim 4, wherein the connection passage further includes a third connection passage which is connected between the first connection passage and the second connection passage and has a constant cross-sectional area, and the first passage and the second passage are positioned on the same center axis, the first connection passage is positioned to be perpendicular to the first passage, the second connection passage is positioned to be perpendicular to the second passage, and the third connection passage has a curved shape.

6. The dishwasher as claimed in claim 2, wherein the passage further includes an introduction passage that connects the connection passage and the blowing fan to each other and has a shape in which a cross-sectional area is decreased toward the connection passage.

7. The dishwasher as claimed in claim 1, further comprising a guide member configured to switch a discharge direction of the sprayed air so that the air sprayed through the discharging ports is directed to the front of the main body.

8. The dishwasher as claimed in claim 7, wherein the discharging ports are provided in an upper portion of the passage, and one end portion of the guide member is connected to an upper surface of the blowing duct and the other end portion of the guide member is positioned on the discharging ports.

9. The dishwasher as claimed in claim 7, wherein the guide member is provided by bending a portion of the main body positioned in the front of the blowing duct.

10. The dishwasher as claimed in claim 1, wherein the discharging ports protrude from an upper surface of the blowing duct, the blowing duct further includes extensions connected to inner walls of the passage to extend the discharging ports, and inner side surfaces of the extensions have a tapered shape.

11. The dishwasher as claimed in claim 1, further comprising an introduction passage configured to connect one side portion of the passage and the blowing fan to each other and having a shape in which a cross-sectional area is decreased toward the passage.

12. A dishwasher comprising:

a main body configured to include a housing, a washing tank being provided in the housing;

a door configured to open and close the washing tank;

a blowing fan configured to suck air from the outside and supply the air to an inside of the housing;

a blowing duct configured to have a passage that provides a flow path through which the air supplied from the blowing fan flows, and a plurality of discharging ports that spray the air flowing through the passage to the outside of the passage; and a guide member configured to switch a flow direction of the air sprayed through the plurality of discharging ports to the front of the main body and to guide a wet steam discharged from the washing tank to forcedly flow to the front of the main body according to the opening of the door, wherein the blowing duct has:

a first spraying part that sprays the air through the plurality of discharging ports formed at one side of the passage; and a second spraying part that sprays the air through the plurality of discharging ports formed at the other side of the passage and is positioned to be spaced apart from the first spraying part, wherein the passage includes:

a first passage having the first spraying part;

a second passage having the second spraying part; and a connection passage which connects the first passage and the second passage in series, and wherein the first passage and the second passage are positioned on the same center axis, and the connection passage has a curved shape.

13. The dishwasher as claimed in claim 12, wherein the first passage has a predetermined cross-sectional area, the second passage has a cross-sectional area corresponding to that of the first passage, and the connection passage has variable sections that change a cross-sectional area through which the air introduced through the first passage flows.

* * * * *